United States Patent [19]

Negrini

[11] 3,984,104

[45] Oct. 5, 1976

[54] PLASTIC BOWLING PIN

[76] Inventor: Maurice Anthony Negrini, 25 Quimby Ave., Woburn, Mass.

[22] Filed: Jan. 29, 1976

[21] Appl. No.: 653,540

[52] U.S. Cl. ..... 273/82 R

[51] Int. Cl.[2] ..... A63D 9/00

[58] Field of Search ..... 273/82 R, 82 A, 80.8, 273/80 D, 82 B; 403/359

[56] References Cited

UNITED STATES PATENTS

| | | | |
|---|---|---|---|
| 3,169,766 | 2/1965 | Ernst | 273/82 R |
| 3,201,124 | 8/1965 | Halip | 273/82 A |
| 3,224,769 | 12/1965 | Nickell | 273/82 A |
| 3,228,687 | 1/1966 | Bauer | 273/82 A |
| 3,232,616 | 2/1966 | Conklin et al. | 273/82 A |
| 3,329,430 | 7/1967 | Wanders | 273/82 R |
| 3,560,032 | 2/1971 | Cohen et al. | 273/80 D X |
| 3,572,710 | 3/1971 | Negrini | 273/82 R |

FOREIGN PATENTS OR APPLICATIONS

| | | | |
|---|---|---|---|
| 3,731 | 9/1926 | Australia | 80.8/ |
| 287,497 | 10/1928 | United Kingdom | 273/80.8 |
| 377,026 | 7/1932 | United Kingdom | 273/80.8 |

*Primary Examiner*—Richard J. Apley
*Attorney, Agent, or Firm*—William Frederick Werner

[57] ABSTRACT

This specification discloses a bowling pin fabricated from plastic material and which incorporates the physical characteristics of a bowling pin fabricated from wood, such as weight, outside dimensions, balance around a vertical axis, base attachment, center of gravity, radius of gyration, scoreability and moment of inertia.

4 Claims, 4 Drawing Figures

PLASTIC BOWLING PIN

STATEMENT OF INVENTION

The present invention relates to bowling pins, and is concerned primarily with a bowling pin of plastic that has all the properties, that are of vital interest to a bowler, of a wooden pin and which properties are imparted to the pin by structural characteristics thereof.

BACKGROUND OF INVENTION

The present invention is a improvement of U.S. Pat. No. 3,572,710 dated Mar. 30, 1971.

Bowling is a sport now meeting with widespread acceptance. Bowlers, by virtue of years of experience with wooden pins, now expect certain properties of the pins with which they play. Perhaps the most important of these properties is the sound which comes from impact with a ball, impact with each other as the pins fly about, and engagement with adjacent alley structure. If a plastic pin is to meet with public acceptance, it is believed it must sound like a wooden pin and react like a wooden pin. This is especially true where tournament play is concerned.

The manner in which one pin affects another as it engages therewith after being forcibly removed from its position of rest by impact with a ball or other pin is also of importance from the aspect of scoring. The total number of pins which are felled by the delivery of a ball depends on the reaction of the pins with each other and with environmental alley equipment. All such reactions should be the same as those derived from wooden pins.

While plastic bowling pins have been proposed, it is believed that none of the now available plastic pins accommodate the above outlined factors to the degree necessary to accord to the plastic pins the widespread acceptance given to the wooden pins.

Accordingly, the present invention incorporates a new construction of an internal flange located at the ball strike or impact zone to improve the sound quality of the pin and provide a lower coefficient of restitution of the pin body to improve the scoring characteristics of the plastic bowling pin.

OBJECTS OF INVENTION

It is, therefore, an object of the present invention to provide a new construction in a plastic bowling pin, wherein the sound qualities and the scoring characteristics are improved.

Another object of the present invention is to provide a new locking collar between the core and body of the pin to strengthen the jarring qualities of the pin.

Still another object of the present invention is to provide a plastic bowling pin having improved cap and base features.

And still another object of the present invention is to provide a plastic bowling pin which has the properties of a wooden pin so far as the necessary physical characteristics are concerned.

Other objects of the present invention will be pointed out in part and become apparent in part in the following specification and claims.

BRIEF DESCRIPTION OF THE DRAWINGS

Referring to the drawings in which similar characters of reference indicate corresponding parts in all the figures.

Figure 1:
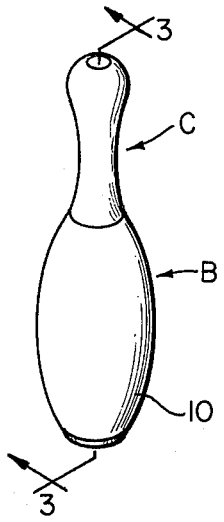
FIG. 1 is a perspective view of a bowling pin embodying the present invention.
Figure 2:
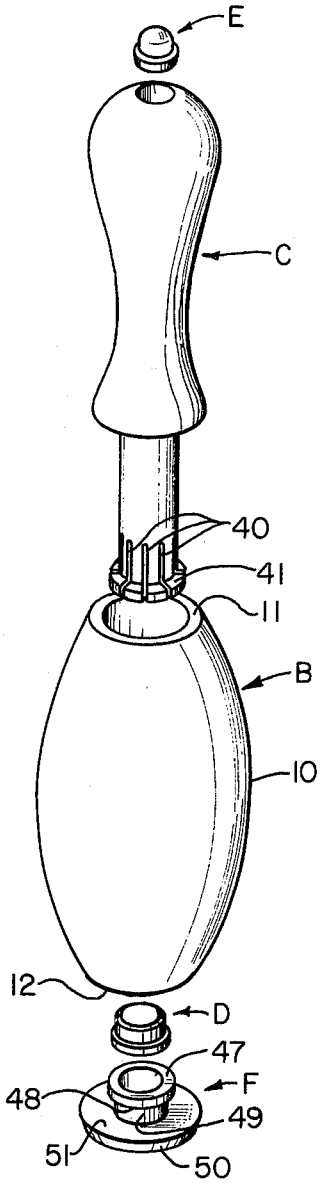
FIG. 2 is an exploded perspective view, showing the several parts constituting the present bowling pin.
Figure 3:
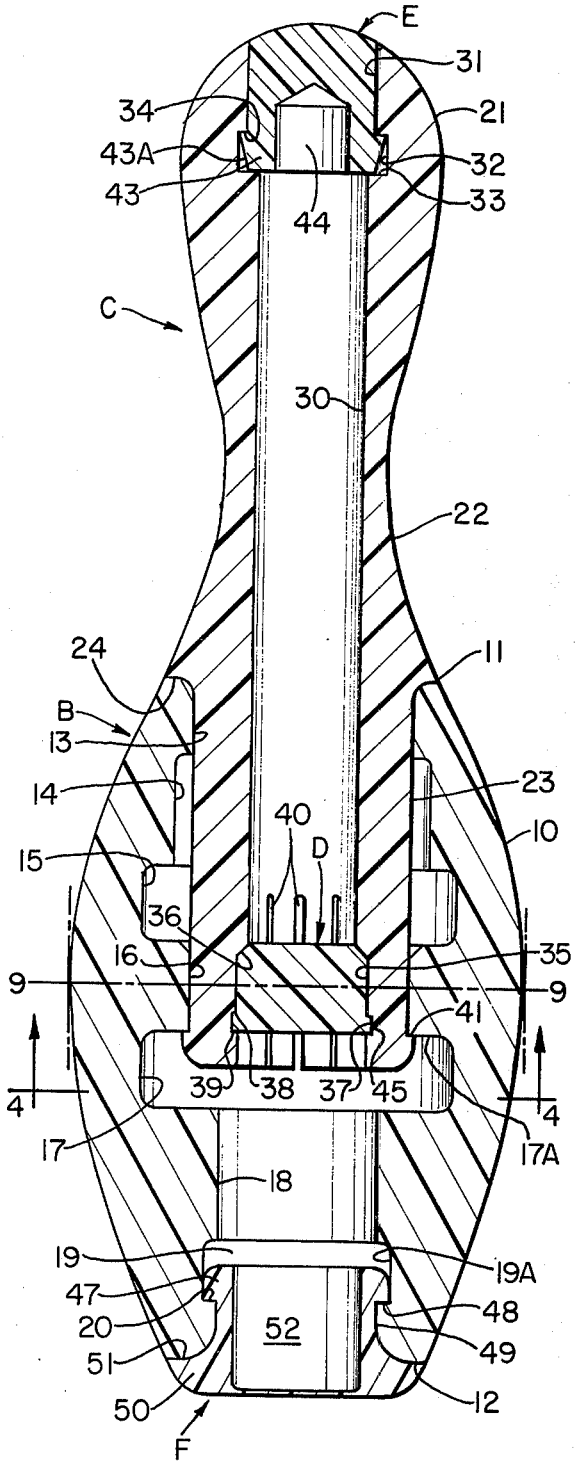
FIG. 3 is a vertical cross sectional view, taken on line 3—3 of FIG. 1.
Figure 4:
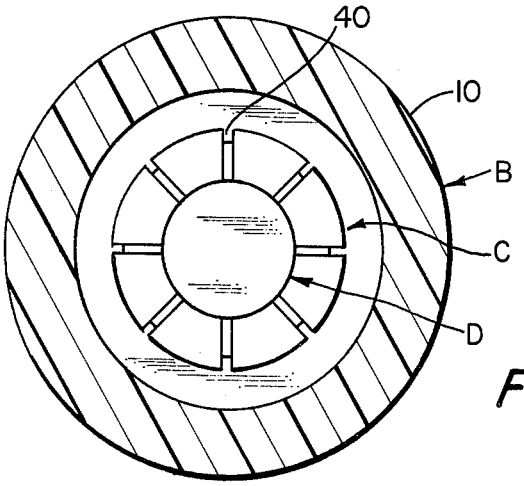
FIG. 4 is a horizontal cross sectional view, taken on line 4—4 of FIG. 3.

In proceeding with this invention, reference is made to the drawings, wherein is shown a plastic bowling pin construction.

The pin comprises five elements, all generally indicated, as a lower body B, an upper body C, a locking collar D, a cap plug E, and a base plug F.

The lower body B and upper body C have an outer contour of a curvature corresponding to that of a conventional bowling pin. Both the lower body B and upper body C have hollow axial configurations. The outer surface 10 of lower body B provides a point of impact 9 at the greatest diameter; line 9—9 also designates the strike zone of the pin or the line of point contact of the ball against the pin. Herein termed the horizontal strike zone.

The upper edge of lower body B provides a shoulder 11 in conjunction with an upper bore section 13 which terminates in a recessed wall 14. An enlarged cavity wall 15 is provided adjacent recessed wall 14 and terminates adjacent a lower bore section 16. A second enlarged cavity wall 17 is provided between lower bore section 16 and an axial bore 18 which terminates as a base plug socket 19 having a wall 19A, a base plug shoulder 20 and a lower end 12. The socket wall 19A has a configuration adapted to receive base plug F. A ledge 17A is formed at the juncture of lower bore section 16 and cavity wall 17.

Upper body C has an outer contour comprising a convex surface 21 and a concave surface 22 which impart a contour to the upper body similar to that of the corresponding part of a conventional bowling pin.

Joining concave surface 22 at its lower end is a cylindrical surface 23 which forms a seat 24 at the juncture of surfaces 22, 23. Cylindrical surface 23 is of a diameter to provide a "drive fit" with upper bore section 13 and lower bore section 16 when the upper body C and lower body B are assembled. Seat 24 abuts shoulder 11.

Upper body C is provided with an axial passageway 30 having a cap plug socket 31 in the upper end. Socket 31 is provided with a groove 32 providing a conical seat 33 and a ledge 34. The lower end of axial passageway 30 is provided with a locking collar socket 35 having a beveled edge 36 and a groove 37 having an upper edge 38 and a lower edge 39. The lower end of upper body C is splined as at 40 and is provided with stop shoulder 41.

Cap plug E has an external flange 43 with a tapered side 43A and a bore 44. Plug E is received in cap plug socket 31 with flange 43 located in groove 32 and with flange 43 abutting conical seat 33 and ledge 34.

During assembly, flange 43 is placed over cap plug socket 31 and driven downwardly in position. Tapered side 43A rides against socket wall 31. Side 43A is permitted to be squeezed into a smaller diameter due to bore 44.

Locking collar D is provided with a circular ridge 45 having a contour adapted to be fitted in groove 37 and be removably secured therein by means of upper edge 38 and lower edge 39. Collar D is also provided with a beveled surface adapted to mate with beveled edge 36.

The spline 40 permits axial passageway 30 to resiliently expand to allow locking collar D to be driven into position with ridge 45 located within groove 37.

Upper body C is forced into position within lower body B with seat 24 against shoulder 11, cylindrical surface 23 abutting upper bore section 13 and lower bore section 16, and with stop shoulder 41 abutting ledge 17A, whereby upper body C is locked into lower body B. Locking collar D, expands the splined area of upper body C to insure that stop shoulder 41 will stay in position against ledge 17A when a bowling ball strikes and jars lower body C therefore upper body C is jarred. It will be noted that the strike zone on line 9—9 passes through the approximate medial section of locking collar D.

Base plug F comprises an upper circular flange 47 having a lip 48, a body portion 49, and a conical end 50 having a flared surface 51. Plug F has a hollow axial area 52.

Base plug F is forced fitted into socket 19 with lip 48 abutting base plug shoulder 20 and with flared surface 51 adapted in configuration to embrace lower end 12. Lip 48 locks base plug F to lower body B. Hollow axial area 52 permits circular flange 47 to be squeezed through socket wall 19A. Flared surface 51 permits the lower end 12 of lower body B to be locked in position against an enlarged area on base plug F.

As previously stated, an object of the present invention is to improve the sound qualities and scoring characteristics of the plastic bowling pin. This is accomplished with two structural features: (1) lower bore section 16 is an internal flange which (a) provides a bearing surface 16 for cylindrical surface 23, and (b) divides the sound chamber into two sections, namely, upper sound chamber comprising recess 14 and enlarged cavity 15 and lower sound chamber comprising second enlarged cavity, and axial bore 18; (2) lower bore section or internal flange 16 is medially located on the horizontal strike zone plane 9—9, thereby reinforcing the strike zone and thereby producing a lower coefficient of restitution of the plastic material. This flange, therefore, improves the scoring characteristics of the plastic pin.

Lower coefficient of restitution is defined; after a bowling ball strikes the bowling pin, the material recovers from compression more slowly than material having a higher coefficient of friction. The mass of material in the flange 16 absorbs the shock or compression of the material to a greater extent than material comprising a small mass and therefore reacts more slowly. This is a highly desirable quality in a plastic bowling pin requiring a sound chamber.

The area of enlarged cavity 15 and the area of second enlarged cavity 17 are approximately equal and affect the sound characteristics of the pin to a greater degree than the additional structural features such as flange 16, recess 14 and axial bore 18 because they are located on opposite sides of the strike zone 9—9 of the pin.

It will be noted that seat 24 is fastened against shoulder 11 and stop shoulder 41 is fastened against lower edge 39 by means of locking collar D which tends to spread axial passageway 30 sideways against flange, or lower bore section 16. This structure prevents upper body C from separating itself, even to a small extent from lower body B when the bowling pin is jarred from stationary position by a bowling ball.

Having shown and described a preferred embodiment of the present invention, by way of example, it should be realized that structural changes could be made and other examples given without departing from either the spirit or scope of this invention.

What I claim is:

1. In a plastic bowling pin, a. a lower body having an outer contour of a curvature corresponding to that of a conventional bowling pin, b. said lower body having a horizontal strike zone at the greatest diameter thereof, and an end, c. said lower body having a hollow axial configuration comprising an upper bore section, a flange medially located on said horizontal strike zone, an upper sound chamber between said flange and said upper bore section, said flange providing a lower bore section, a lower sound chamber between said flange and said end, d. an upper body having an outer contour comprising a convex surface and a concave surface providing a configuration similar to that of the corresponding part of a conventional bowling pin, and a cylindrical surface, e. said upper body provided with an axial passageway having a locking collar socket and a spline surrounding said locking collar socket, f. a locking collar, g. means securing said locking collar in said locking collar socket, with said strike zone passing through the medial area of said locking collar, h. means securing said upper body to said lower body with said cylindrical surface engaging said upper bore section and said lower bore section.

2. In a plastic bowling pin, a. a lower body having an outer contour of a curvature corresponding to that of a conventional bowling pin, b. said lower body provided with a shoulder at the upper edge thereof and a strike zone at the greatest diameter thereof, c. said lower body having a hollow axial configuration comprising an upper bore section starting at said shoulder and terminating in a recessed wall, an enlarged cavity adjacent said recessed wall and terminating in a lower bore section, a second enlarged cavity wall forming a ledge with said lower bore section and terminating in an axial bore, d. said lower bore section constituting a flange, said recessed wall and said enlarged cavity constituting an upper sound chamber on one side of said flange, said second enlarged cavity and said axial bore constituting a lower sound chamber on the other side of said flange, e. said flange located medially on a horizontal plane passing through said stroke zone, said flange providing a mass of material in said strike zone to provide a low coefficient of restitution in the material in said strike zone, f. an upper body having an outer contour comprising a convex surface and a concave surface providing a configuration similar to that of the corresponding part of a conventional bowling pin, g. a cylindrical surface forming a seat at the lower end of said concave surface, and a stop shoulder adjacent to the end opposite said seat, h. said cylindrical surface engaging said upper bore section, and lower bore section, and with said seat engaging said shoulder, i. said upper body provided with an axial passageway having a locking collar socket and a spline surrounding said locking collar socket, j. a locking collar, k. means securing said locking collar in said locking collar socket, with said strike zone passing through the medial area of said locking collar, and with said stop shoulder engaging said ledge to secure said upper body to said lower body.

3. The bowling pin of claim 1 in which said enlarged cavity and said second enlarged cavity approximate equal areas.

4. In a plastic bowling pin, a. a lower body having an outer contour of a curvature corresponding to that of a conventional bowling pin, b. said lower body provided with a shoulder at the upper edge thereof and a strike zone at the greatest diameter thereof, c. said lower body having a hollow axial configuration comprising an upper bore section starting at said shoulder and terminating in a recessed wall, an enlarged cavity adjacent said recessed wall and terminating in a lower bore section, a second enlarged cavity wall forming a ledge with said lower bore section and terminating in an axial bore having a base plug socket provided with a wall, a base plug shoulder and a lower end, d. said wall having a configuration adapted to receive a base plug, e. an upper body having an outer contour comprising a convex surface and a concave surface providing a configuration similar to that of the corresponding part of a conventional bowling pin, f. a cylindrical surface forming a seat at the lower end of said concave surface, and a stop shoulder adjacent to the end opposite said seat, g. said cylindrical surface having a "drive fit" connection with said upper bore section and lower bore section, and with said seat abutting said shoulder, h. said upper body provided with an axial passageway having a cap plug socket in the upper end, a locking collar socket having a groove and a spline, surrounding said locking collar socket in the opposite end, i. a locking collar provided with a circular ridge, j. means securing said locking collar in said locking collar socket with said circular ridge located in said groove, and with said strike zone passing through said lower bore section and through the medial area of said locking collar, and with said stop shoulder abutting said ledge, to secure said upper body to said lower body, k. a cap plug fastened in said cap plug socket, l. a base plug, having a hollow axial area, m. means fastening said base plug in said base plug socket through said base plug shoulder, and n. said base plug having a configuration adapted to abut said wall having a configuration adapted to receive a base plug.

* * * * *